United States Patent [19]

Williams

[11] 4,269,042

[45] May 26, 1981

[54] CENTRIFUGE REFRIGERATION SYSTEM

[75] Inventor: John F. Williams, New Canaan, Conn.

[73] Assignee: E. I. Du Pont de Nemours and Company, Wilmington, Del.

[21] Appl. No.: 80,083

[22] Filed: Sep. 28, 1979

[51] Int. Cl.[3] ..... F25B 41/00

[52] U.S. Cl. ..... 62/513; 62/511; 62/527

[58] Field of Search ..... 62/113, 511, 513, DIG. 17, 62/527

[56] References Cited

U.S. PATENT DOCUMENTS

| | | | |
|---|---|---|---|
| 2,020,860 | 11/1935 | Touborg | 62/513 |
| 2,694,296 | 11/1954 | Prosek et al. | 62/511 |
| 2,847,835 | 8/1958 | Cooper et al. | 62/511 |
| 3,064,449 | 11/1962 | Rigney | 62/513 |
| 3,677,028 | 7/1972 | Raymond | 62/511 |
| 3,952,533 | 4/1976 | Johnston et al. | 62/513 |

*Primary Examiner*—Ronald C. Capossela

[57] ABSTRACT

A conventional centrifuge refrigeration system is modified by connecting a capillary sized line between the expansion valve and the evaporator. This permits the expansion valve to be located at a point within the centrifuge remote from the rotor. This facilitates the easy removal of the expansion valve for repair and yet reduces icing of the expansion valve. Further, the system capacity may be improved by wrapping the capillary line about the suction line to effect subcooling of the refrigerant before it passes to the evaporator. This enhances system capacity.

3 Claims, 1 Drawing Figure

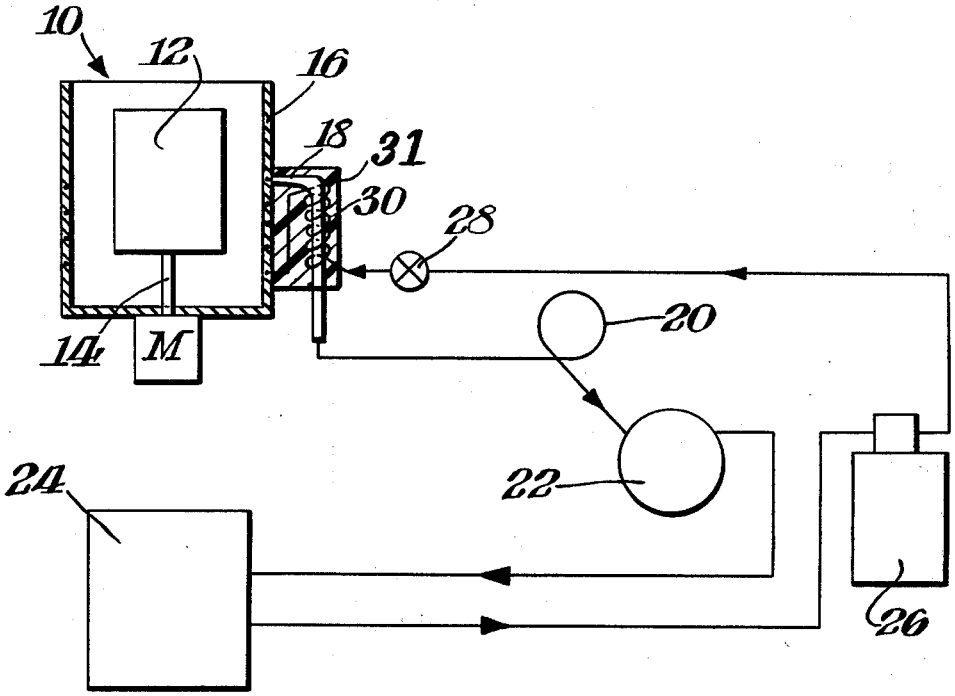
10
12
16
18
31
30
28
20
14
M
22
24
26

CENTRIFUGE REFRIGERATION SYSTEM

BACKGROUND OF THE INVENTION

This invention relates to centrifuge refrigeration systems. Many centrifuges are provided with a refrigeration capability to maintain samples in the centrifuge rotor at a desired low temperature while they are undergoing centrifugation. To achieve the desired cooling, the rotor chamber of the centrifuge is surrounded by refrigeration coils. These coils, which constitute the evaporator in a typical refrigeration system, are supplied with refrigerant through the usual expansion valve which controls the flow of the refrigerant.

While this is conventional practice, a problem encountered with centrifuges is that, due to the usual space limitations in the rotor housing, the expansion valve for the evaporator, if located immediately adjacent the evaporator, is difficult to remove and/or repair. On the other hand, if the expansion valve is located at a distance from the evaporator so that it can be removed or repaired, it can undergo icing and, in any event, the cooling capability of the system is reduced. Both effects are undesirable.

It is known to use a capillary tube or line in lieu of an expansion valve. This delays the expansion of the refrigerant until it reaches the evaporator and hence the loss of the cooling capability is avoided. Unfortunately, a capillary line permits no variable control over the rate of flow of fluid through the evaporator as is provided by the feedback control of the expansion valve. Hence, the mere use of a capillary line is an undesirable solution.

SUMMARY OF THE INVENTION

One form of the invention is used in a centrifuge refrigeration system having a fluid interconnected compressor, condenser, expansion valve, evaporator located contiguous the rotor cavity of said centrifuge for cooling said cavity, and finally a suction line connected between the outlet of said evaporator and said compressor. The system operates to transfer a refrigerant for expansion in said evaporator to effect cooling of the centrifuge rotor. The system is improved in accordance with this invention by using a capillary sized line connected between the expansion valve and the evaporator to permit locating the expansion valve at a point removed from the centrifuge rotor. Preferably, the capillary sized line is wrapped around the suction line from the evaporator and the suction line, so wrapped, is thermally insulated from the remainder of the centrifuge. This facilitates repair of the expansion valve, reduces icing of the expansion valve, and improves overall system capacity by subcooling the refrigerant by the lower temperature of the suction line.

BRIEF DESCRIPTION OF THE DRAWING

Further advantages and features of this invention will become apparent upon consideration of the drawing in which the sole FIGURE is a block diagram of a refrigeration system constructed in accordance with a preferred embodiment of this invention.

DESCRIPTION OF THE PREFERRED EMBODIMENT

It may be seen with reference to the sole FIGURE that the rotor cavity 10, of a conventional refrigerated-type centrifuge, houses a rotor 12 driven through a drive shaft 14 which is driven in turn by a suitable prime mover such as a motor M. A conventional refrigeration system for a centrifuge includes an evaporator, having expansion or refrigeration coils positioned within an annular sleeve type housing 16 surrounding and partially enclosing the rotor cavity 10. The outlet of the evaporator is connected through a suction line 18 and anti-vibration loop 20 to the suction inlet of a compressor 22. The outlet of the compressor 22 is connected through a condenser 24 and a filter/dryer 26 to an expansion valve 28. The expansion valve, which may be a thermal expansion valve, is coupled to sense the temperature at the suction line 18. The degree to which the expansion valve opens or closes is a function of the temperature of the suction line, i.e., if the temperature of the suction line increases, the flow of refrigerant through the expansion valve is increased and vice versa. Any of the other well-known types of expansion valves may be used as desired.

In accordance with this invention, a capillary tube 30 is connected to the outlet of the expansion valve, wrapped several turns around the suction line 18, and then coupled to the inlet of the evaporator 16. Preferably, the suction line, thus wrapped with the capillary tube, is thoroughly insulated by a suitable insulation, such as a foam type shown schematically at reference numeral 31, from the remainder of the centrifuge and the atmosphere.

With this arrangement, the expansion valve may be located at a point remote from the evaporator itself. This is particularly desirable since, in the region of the evaporator, space is at a premium. If the valve is so located in or near the rotor chamber, it is very difficult to repair and/or replace. The capillary line is selected typically of a tubing having ⅛ inch (0.3175 cm) outside diameter, and in a typical super speed centrifuge system, may be approximately 27 inches (68.58 cm) long. Actually, the length of the line is sized to match the evaporator and compressor capacities, i.e., the refrigeration capacity of the system. It is desirable that the length not be so long as to create a major portion of the pressure drop between the condenser and the evaporator, that is, a pressure drop greater than that created by the expansion valve. It is desirable that the expansion valve rather than the capillary tube primarily control the flow of a refrigerant to the evaporator. The capillary line is used to transfer the point at which expansion of the refrigerant begins from the expansion valve to the evaporator itself. The capillary line need not be wrapped around the suction line, but this is preferred because of the subcooling of the refrigerant made possible thereby.

In the operation of the system described, the compressor compresses the refrigerant, now in gaseous state as a result of its expansion in the evaporator, and passes it through the condenser where it is cooled back to a liquid state. Any water or other particulate matter in the refrigerant is removed by the filter/dryer 26 and thence passed through the expansion valve. If a thermal valve is used, the flow rate is controlled by the temperature in the suction line. The refrigerant is then passed through the capillary line 30. This line 30 due to its small diameter and resulting high pressure drop, prevents the expansion of the refrigerant from taking place until the fluid has reached the evaporator itself. Subcooling takes place as it contacts the suction line which is at a low temperature. This subcooling has the function of improving system capacity. Furthermore, by transferring the expansion of the refrigerant from the area of the expansion valve to the evaporator, the valve itself is less subject to icing which would otherwise be the case. The refrigerant is allowed to expand in the low pressure present in the evaporator, thereby effecting the desired cooling. The now expanded refrigerant, having returned to gaseous state, is withdrawn through the suction line back through the anti-vibration loop 20 to the compressor 22 to complete the cycle.

There has thus been described a relatively simple system for improving the capacity of a centrifuge refrigeration system and yet permitting the location of the expansion valve at a point remote from the evaporator.

I claim:

1. In a centrifuge system having a fluid interconnected compressor, condenser, expansion valve, evaporator, located contiguous the rotor cavity of said centrifuge for cooling said cavity, and finally a suction line connected between the outlet of said evaporator and said compressor, said system operating to transfer a referigerant for expansion in said evaporator to effect cooling of said centrifuge rotor, the improvement wherein a capillary sized line is connected between said expansion valve and said evaporator to permit locating said expansion valve at a point removed from said centrifuge rotor.

2. A centrifuge system of claim 1 wherein said capillary sized line is wrapped around said suction line.

3. A centrifuge system of claim 2 wherein said capillary line wrapped around said suction line insulates said suction line from the remainder of said centrifuge.

* * * * *